US012303741B2

(12) United States Patent
Joseph

(10) Patent No.: US 12,303,741 B2
(45) Date of Patent: May 20, 2025

(54) SYSTEM AND METHOD FOR WORKOUT APPARATUS

(71) Applicant: Gerard Joseph, Melbourne, FL (US)

(72) Inventor: Gerard Joseph, Melbourne, FL (US)

( * ) Notice: Subject to any disclaimer, the term of this patent is extended or adjusted under 35 U.S.C. 154(b) by 323 days.

(21) Appl. No.: 17/990,764

(22) Filed: Nov. 21, 2022

(65) Prior Publication Data

US 2023/0347207 A1 Nov. 2, 2023

Related U.S. Application Data

(60) Provisional application No. 63/335,643, filed on Apr. 27, 2022.

(51) Int. Cl.
*A63B 23/16* (2006.01)
*A63B 21/00* (2006.01)

(52) U.S. Cl.
CPC ..... *A63B 23/16* (2013.01); *A63B 21/4019* (2015.10); *A63B 2225/09* (2013.01)

(58) Field of Classification Search
CPC . A63B 21/06; A63B 21/4019; A63B 21/4035; A63B 23/1236; A63B 23/16; A63B 2225/09
See application file for complete search history.

(56) References Cited

U.S. PATENT DOCUMENTS

| | | | | |
|---|---|---|---|---|
| 7,063,646 | B1 * | 6/2006 | Slimi | A63B 22/14 482/141 |
| 9,205,299 | B1 * | 12/2015 | Hall | A63B 21/0552 |
| 10,583,321 | B2 * | 3/2020 | Panes | A63B 23/0211 |
| 10,946,241 | B2 * | 3/2021 | KashKash | A63B 21/00058 |
| 10,981,026 | B2 * | 4/2021 | Sudeith | A63B 71/03 |
| 11,911,657 | B1 * | 2/2024 | KashKash | A63B 21/0628 |
| 12,005,314 | B2 * | 6/2024 | Allen | A63B 21/068 |
| 2011/0173778 | A1 * | 7/2011 | Wales | B25G 3/20 16/426 |
| 2014/0194265 | A1 * | 7/2014 | Torres | A63B 23/02 482/141 |
| 2015/0208800 | A1 * | 7/2015 | Yang | A61F 5/00 297/488 |
| 2021/0402242 | A1 * | 12/2021 | KashKash | A63B 21/022 |
| 2022/0233915 | A1 * | 7/2022 | Allen | A63B 23/1236 |

* cited by examiner

*Primary Examiner* — Joshua Lee
(74) *Attorney, Agent, or Firm* — Christopher Mayle

(57) ABSTRACT

A system and method for an attachment that re-enacts the fingertip pushup popularized by Bruce Lee, whereby the attachment allows people to do fingertip pushups at a gym on a traditional chest machine. During use, one piece attaches to the left and right side of the chest machine whereby instead of grabbing a bar the user puts their hands on a flat piece of the attachment with only finger tips touching and it trains fingers, wrist, and forearms as isometric training.

18 Claims, 6 Drawing Sheets

SYSTEM AND METHOD FOR WORKOUT APPARATUS

CROSS REFERENCE TO RELATED APPLICATIONS

This application claims priority to U.S. Provisional Patent No. 63/335,643 filed on Apr. 27th 2022 which is incorporated in its entirety.

FIELD OF DISCLOSURE

The field of disclosure is generally directed to a securing apparatus for exercise, and more particularly, a system and method for an apparatus that accommodates exercise machines of varying sizes and secures the exercise machine to provide a method of performing a finger push up.

BACKGROUND

Regular physical activity can improve muscle strength and boost endurance. Exercise delivers oxygen and nutrients to bodily tissues and helps the cardiovascular system work more efficiently. Exercise helps people lose weight and lower the risk of some diseases. Exercising regularly decreases a person's risk of developing certain diseases, including obesity, type 2 diabetes, and high blood pressure. Exercise can also help a person age well.

A method of exercise includes the finger push up, popularized by Bruce Lee, which not only provides the benefits of a push up but also strengthens the wrists as the wrist needs to work hard to stabilize your body. Another advantage is that they also strengthen stability and core since the hands have less surface area that is touching the ground making it harder to balance. However, this exercise can be difficult to do even for intermediate trainers and currently lacks a way for beginners to develop the ability to perform the exercise.

Chest exercise machines may be helpful but are used in a traditional manner whereby the chest exercise machines do not provide workouts for multiple body muscles that would help develop the ability to perform finger push-ups. Thus, there is a need for an attachment developed for a chest exercise machine offering the freedom to work out the body in a variety of positions using their fingers.

SUMMARY

The present invention is directed to a piece of workout equipment attachment that re-enacts the fingertip pushup popularized by Bruce Lee, whereby the attachment allows people to do fingertip pushups at a gym on a traditional chest machine. During use, one piece attaches to the left and right side of the chest machine whereby instead of grabbing a bar the user puts their hands on a flat piece of the attachment with only finger tips touching and it trains fingers, wrist, and forearms as isometric training.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
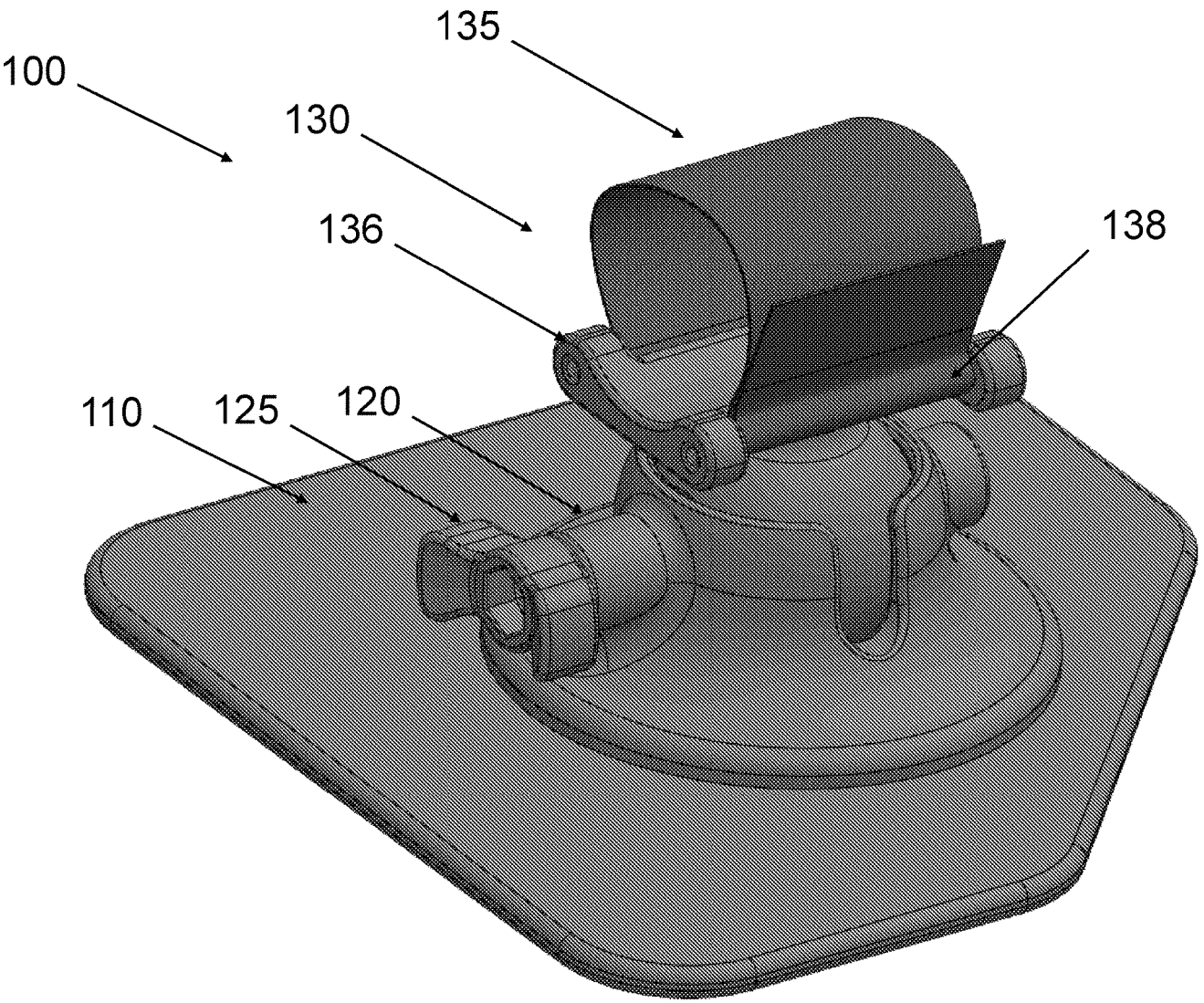
FIG. 1 is a top perspective view of an exemplary attachment device.
Figure 2:
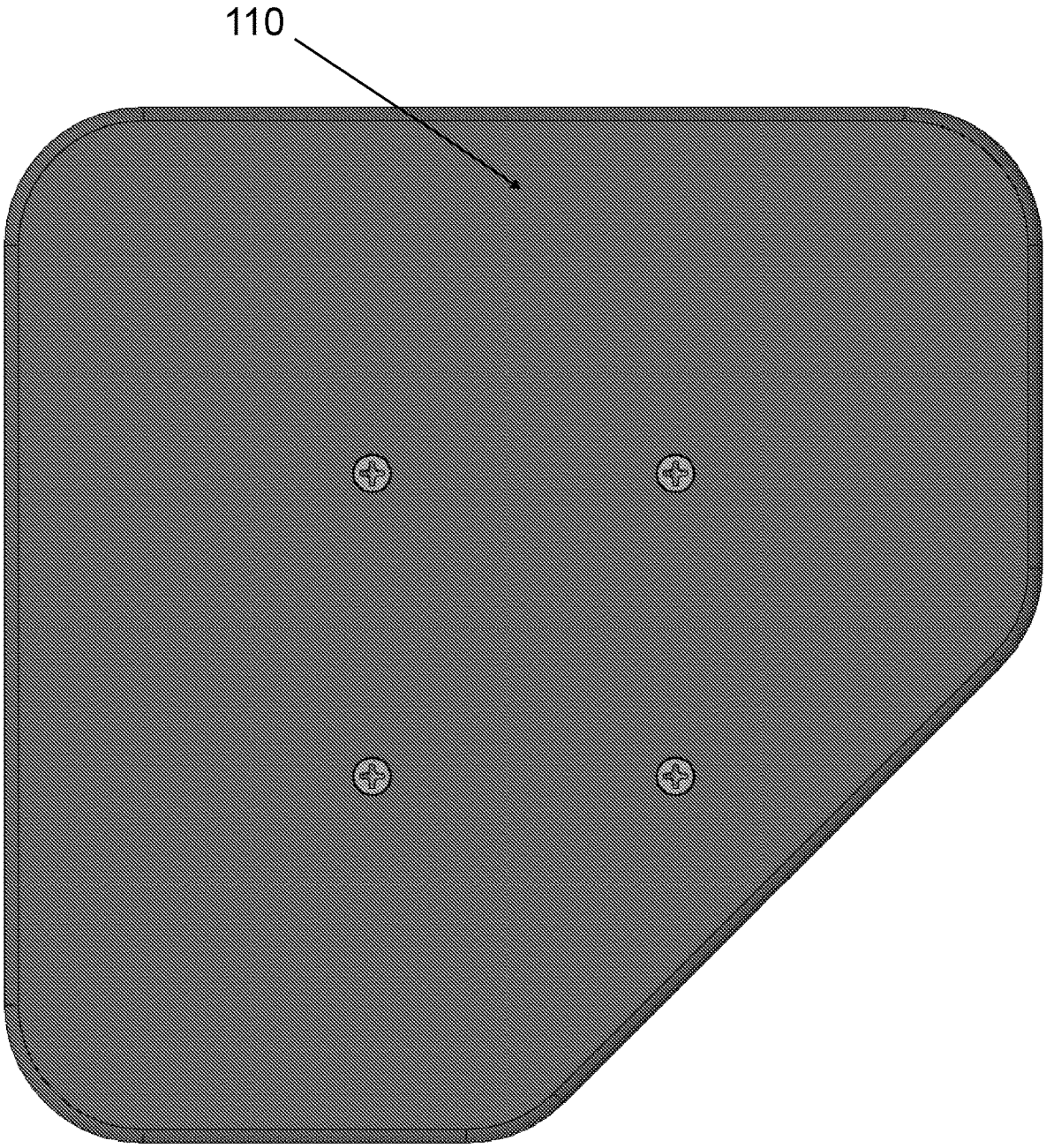
FIG. 2 is a bottom view of the attachment device of FIG. 1.
Figure 3:
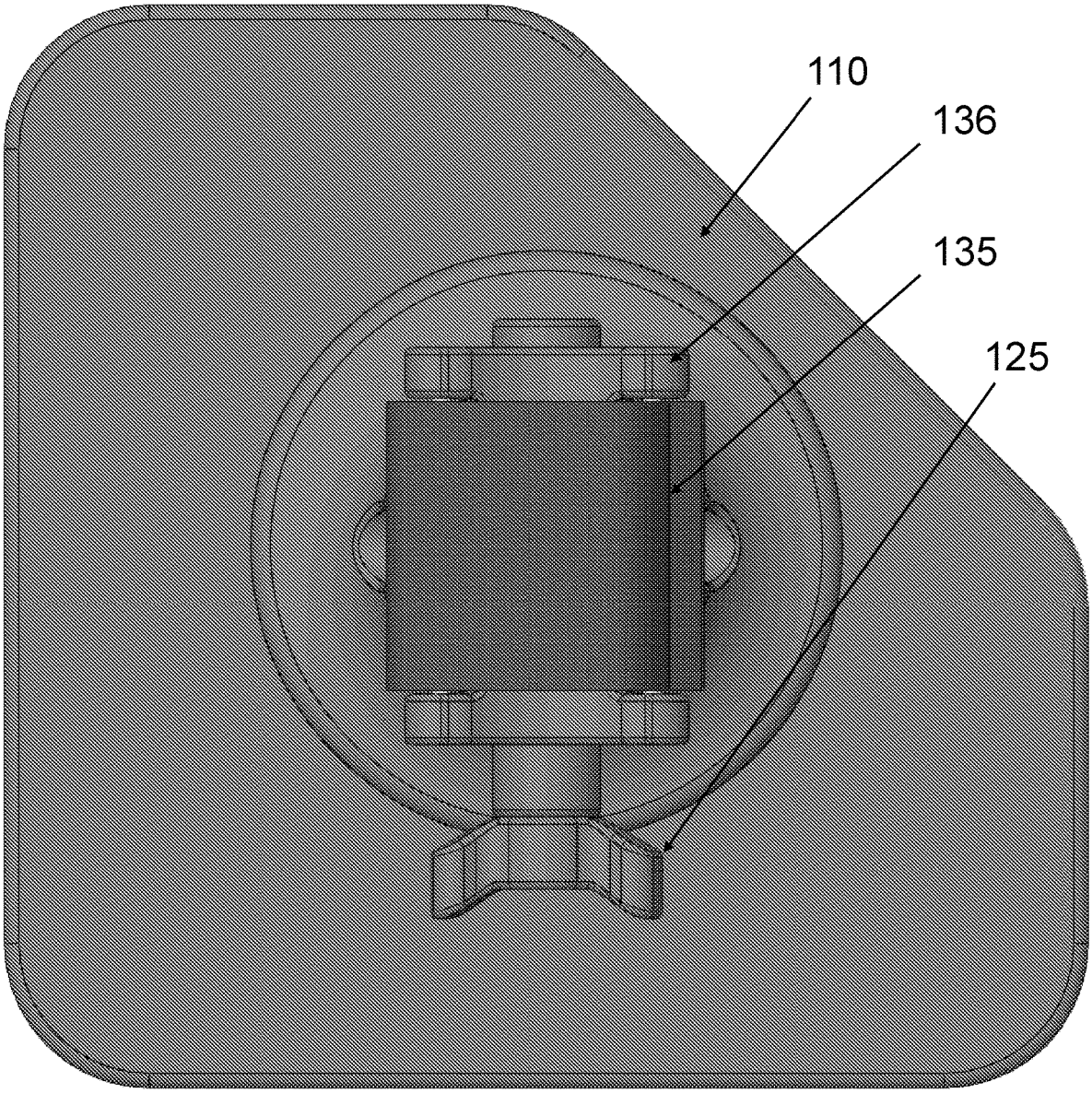
FIG. 3 is a top view of the attachment device of FIG. 1.
Figure 4:
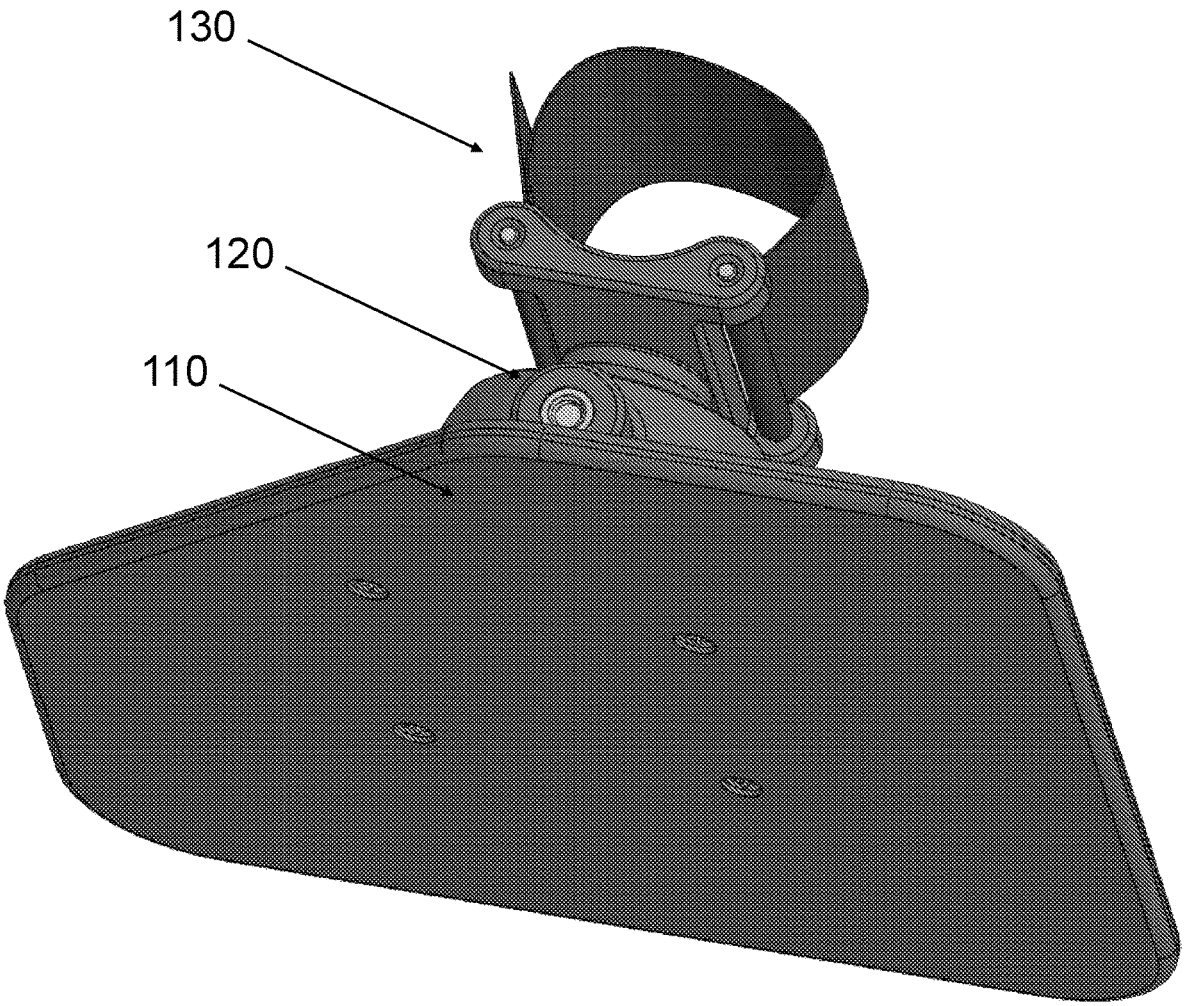
FIG. 4 is a side perspective view of the attachment device of FIG. 1.

In the Summary above and in this Detailed Description, and the claims below, and in the accompanying drawings, reference is made to particular features (including method steps) of the invention. The term "comprises," and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)— (a second number)," this means a range whose lower limit is the first number and upper limit is the second number.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present disclosure is generally drawn to a system and method, according to one or more exemplary embodiments, for securing an exercise apparatus to a traditional chest machine or other exercise machine. FIG. 1-4 illustrate one embodiment of exercise apparatus, referred to as exercise apparatus 100. Exercise apparatus 100 may have a base 110, an adjusting mechanism 120, and a fastening mechanism 130 whereby a first exercise apparatus 100 may be connected to the left side handle of a chest machine while a second exercise apparatus 100 may be connected to the right side handle of the chest machine. It should be appreciated that a user may use a single exercise apparatus 100 or multiple depending on need and what muscles they want to activate during exercise.

Base 110 may be of a size and shape to fit the user's fingers to perform the exercise. Base 110 may include a bottom wall and top wall, which each have an inner and outer surface. Base 110 may be asymmetrical with a pentagon shape having a first horizontal surface that extends down into a first vertical surface and second vertical surface whereby the first vertical surface extends longer than the second vertical surface. The second vertical surface may be connected to a diagonal surface that is angled inward to the first vertical surface. The diagonal surface may be connected to the first vertical surface by a second horizontal surface that is parallel with the first horizontal surface. This may be the exercise apparatus 100 connected to the right or left handle of the chest machine whereby a second exercise apparatus 100 would be a mirror image and used on the opposite handle. Those of ordinary skill in the art will appreciate that base 110 may include any number of shapes and sizes in various configurations and is not limited to those depicted in the Figures or described above.

Base 110 may have one or more gripping surfaces, whereby the gripping surfaces are made of any material or any adhesive whereby the material prevents slippage between exercise apparatus 100 and the user. The coverage area of the material may be an externally applied adhesive coating or the material may be impregnated within base 110. Alternatively, any type of gripping surface as known in the art may be used on base 110. Base 110 may have one or more apertures, to receive one or more fasteners whereby base 110 may be affixed to adjusting mechanism 120 with, for example, fasteners, adhesive, latches, hinges, welding techniques, or any other method known to those skilled in the art.

Adjusting mechanism 120 may be a ball and socket connection having a first end segment and a second end segment whereby the ball may be positioned at multiple angles to accommodate for various shaped exercise machines. An engaging end surface is present at the first end segment. The second end segment is substantially or completely hollowed out. The surface of the receiving cavity is tailored to fit the engaging end surface. In some non-limiting embodiments, a bulge may protrude from a surface of the receiving cavity to stop the movement of the engaging end surface thus preventing over angulation or separation in the connection. The receiving cavity wall thickness and/or the engaging end surface wall thickness are built whereby an interference fit is present after the ball and socket joint connection is linked. It should be appreciated that the ball and socket mechanism may include any number of shapes, hollow areas, and sizes in various configurations and is not limited to those described above.

In some non-limiting embodiments, adjusting mechanism 120 may have a latch mechanism 125 having a position locking twist mechanism operable in relation to the ball and socket mechanism whereby the twist locking mechanism is used to selectively lock in the angle of the ball and socket mechanism, thereby adjusting the angle of the exercise apparatus 100 to accommodate for the varying distances between the user and the handles of the chest machine. Disengaging the twist locking mechanism releases latch mechanism 125 into a disengaged position whereby the ball of adjusting mechanism 120 may freely move relative to the socket component in a rotational motion.

Adjusting mechanism 120 may be connected to fastening mechanism 130 with a strap 135 that is positioned around or otherwise connected to the handles of the chest exercise machine. Adjusting mechanism 120 may have a holder 136 having a u shaped body with two cylindrical rollers 138 on opposite sides designed for holding strap 135. Strap 135 may be made of nylon or any other suitable material. Strap 135 may have any number of lengths depending on the need and circumstances whereby it may be stretchable enough to stretch over the handle and then revert to its original size snapping strap 135 over the handles of the chest exercise machines. Holder 136 may act as a buckling system whereby strap 135 may be permanently fastened to one roller 138 whereby strap 135 may be threaded through a slot in holder 136 then be folded over on the back of roller 138. A stitching may then be placed near roller 138 to fasten the overlapping lengths of strap 135. Strap 135 may be removably fastened to the opposite roller 138 whereby a free end of strap 135 may be threaded through a space of holder 136, then the end of strap 135 may be threaded over a ribbed center bar and into a another hole such that strap may be secured over the handles of the chest exercise machine and then pulled tight. In other non-limiting embodiments strap 135 may utilize other types of fasteners such as Velcro whereby the ends of strap 135 may have compatible connectors to connect to the handles of the chest exercise machine.

During use, the user may position a first strap 135 of an exercise apparatus 100 over the left handle of the chest exercise machine a second strap 135 of a second exercise apparatus over the right handle of the chest exercise machine. User may then orientate adjusting mechanism 120 to find the proper angle of the two exercise apparatus and use latch mechanism 125 to lock in the position. User may then place their fingers on base 110 and train their fingers, wrist, and forearms as isometric training with a fingertip chest exercise with a desired weight.

Figure 5:
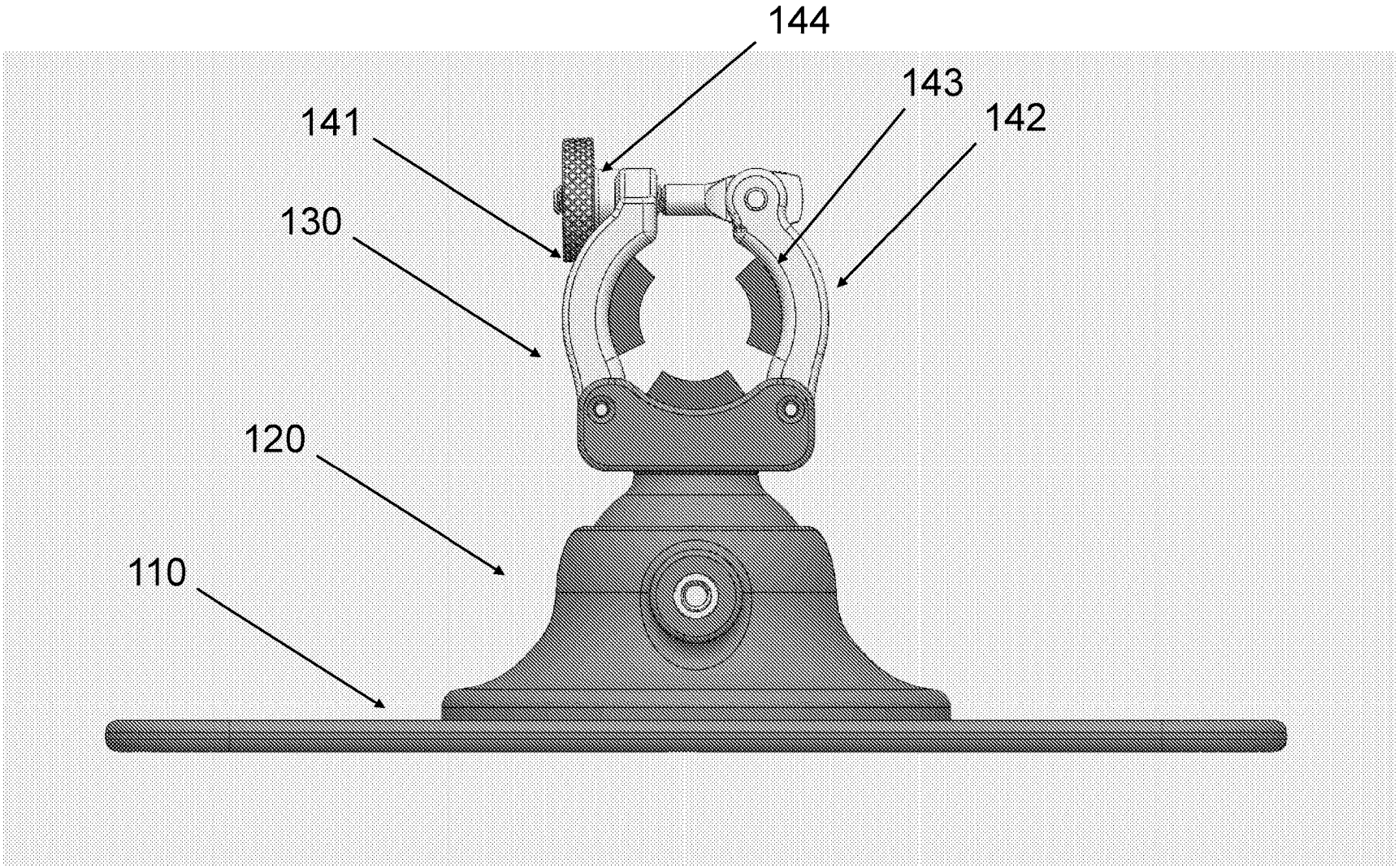
FIG. 5 illustrates another embodiment of the attachment device.
Figure 6:
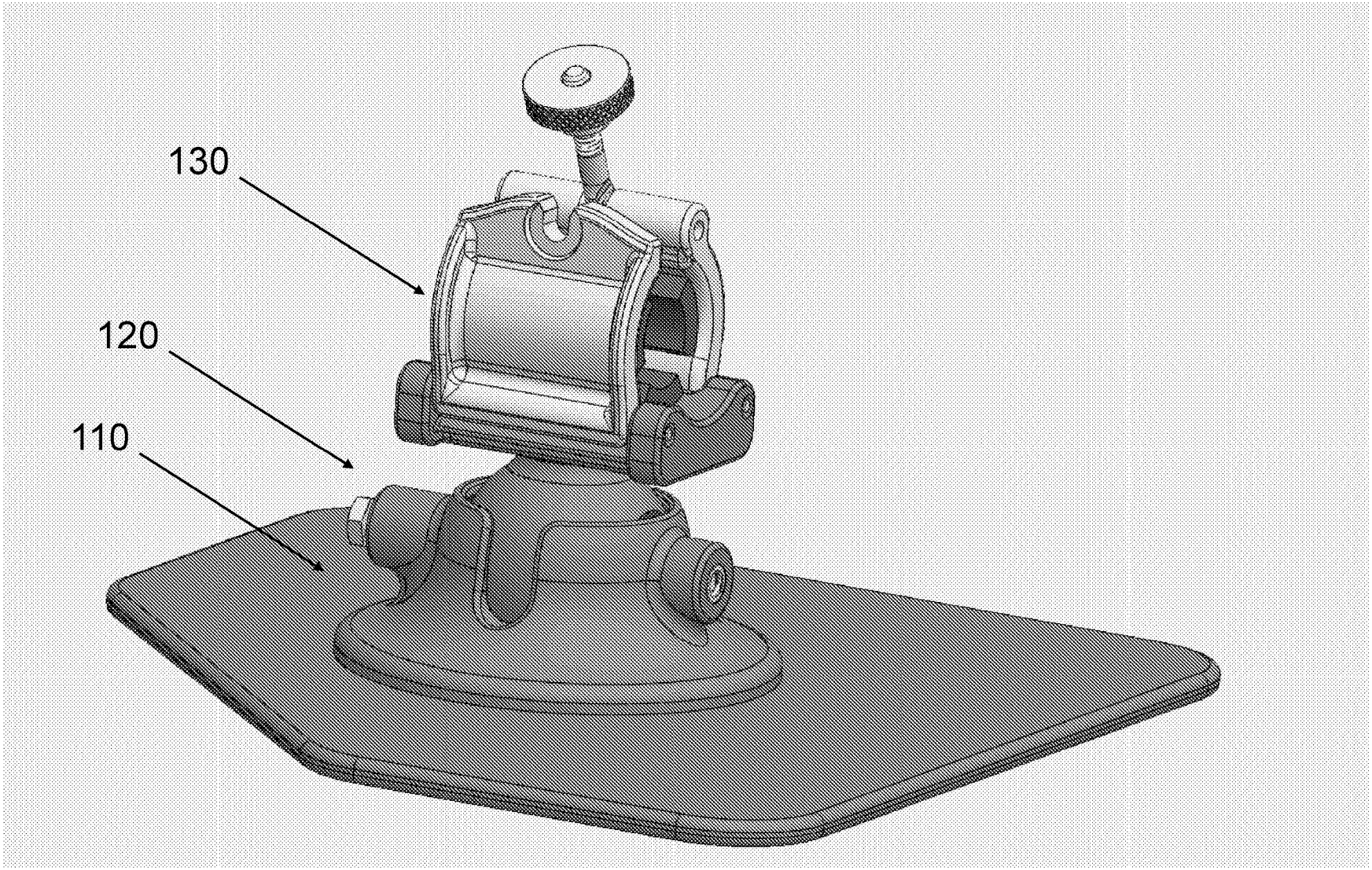
FIG. 6. Illustrates another view of the attachment device in FIG. 5.

In one or more non-limiting embodiments fastening mechanism 130 may be a clamp mechanism as illustrated in FIG. 5 and FIG. 6. Clamping device may have a first member 141 and a second member 142 symmetrical to first member 141 where they are both rotational to one another whereby a material is clampable between first member 141 and second member 142. First member 141 and second member 142 may be connected to holder 136. Second member 142 and first member 141 may be fastened by a position locking turn mechanism 144 to tighten the clamp, whereby an aperture is formed between first member 141 and second member 142

In some embodiments, first member 141 and second member 142 may have one or more wedges 143 or other mechanisms that move inward whereby the inner surfaces of the wedges frictionally engage with the workout machine. In some non-limiting embodiments, textures or other gripping elements may incorporated into wedges 143 to increase the friction. The position locking turn mechanism 144 may move from an active position (unlocked phase) in which wedges 143 are released from the exercise machine allowing linear movement of fastening mechanism 130 to an inactive position (locked phase) in which wedges are clamped onto exercise machine.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. An exercise apparatus comprising:

a base configured to receive fingers of a user;

an adjusting mechanism for adjusting an orientation of the exercise apparatus with respect to the user; and a fastening mechanism to connect to an existing exercise machine.

2. The exercise apparatus of claim 1 wherein the base is asymmetrical.

3. The exercise apparatus of claim 2 wherein the base is pentagonal in shape.

4. The exercise apparatus of claim 2 wherein the base has a first horizontal surface that extends down into a first vertical surface and a second vertical surface, wherein the first vertical surface extends longer than the second vertical surface, wherein the second vertical surface is connected to a diagonal surface that is angled inward to the first vertical surface, wherein the diagonal surface is connected to the first vertical surface by a second horizontal surface that is parallel with the first horizontal surface.

5. The exercise apparatus of claim 1 further comprising a second exercise apparatus.

6. The exercise apparatus of claim 1 wherein the adjusting mechanism is a ball and socket mechanism.

7. The exercise apparatus of claim 6 further comprising a position locking latch mechanism used to secure an orientation of the ball and socket mechanism.

8. The exercise apparatus of claim 1, wherein the fastening mechanism has a strap to secure the exercise apparatus to a handle of the existing exercise machine.

9. The exercise apparatus of claim 8, wherein the existing exercise machine is a chest press machine.

10. The exercise apparatus of claim 8, wherein the strap is made of a stretchable material to stretch over the handle.

11. The exercise apparatus of claim 10, wherein the strap is connected to a holder for tightening the strap around the handle.

12. An exercise apparatus system secured to a chest machine comprising:

a first exercise apparatus with a first flat base configured to receive fingers of a user, a first lockable ball and socket mechanism for adjusting an orientation of the first exercise apparatus with respect to the user, and a first strap to secure the first exercise apparatus to a first handle of the chest machine.

13. The exercise apparatus system of claim 12 further comprising a second exercise apparatus with a second flat base configured to receive the fingers of the user on an opposite hand, a second lockable ball and socket mechanism for adjusting an orientation of the second exercise apparatus with respect to the user, and a second strap to secure the first exercise apparatus to a second handle of the chest machine.

14. The exercise apparatus system of claim 13, wherein the first strap and the second strap are made of a stretchable material to stretch over the first handle and the second handle.

15. The exercise apparatus system of claim 13, wherein the first strap and the second strap are connected to a first holder and a second holder, respectively, for tightening the first strap and the second strap.

16. The exercise apparatus system of claim 13 wherein the first flat base and the second flat base are asymmetrical and mirror one another.

17. The exercise apparatus system of claim 16 wherein the first flat base and the second flat base are pentagonal in shape.

18. The exercise apparatus system of claim 17 wherein the first flat base and the second flat base each has a first horizontal surface that extends down into a first vertical surface and a second vertical surface, wherein the first vertical surface extends longer than the second vertical surface, wherein the second vertical surface is connected to a diagonal surface that is angled inward to the first vertical surface, wherein the diagonal surface is connected to the first vertical surface by a second horizontal surface that is parallel with the first horizontal surface.

* * * * *